US008031157B2

(12) United States Patent
Ando et al.

(10) Patent No.: US 8,031,157 B2
(45) Date of Patent: Oct. 4, 2011

(54) OUTPUT CIRCUIT AND LIQUID CRYSTAL DISPLAY DEVICE

(75) Inventors: Tomohiro Ando, Yokohama (JP); Masaji Ueno, Sagamihara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 902 days.

(21) Appl. No.: 11/961,065

(22) Filed: Dec. 20, 2007

(65) Prior Publication Data

US 2008/0150872 A1 Jun. 26, 2008

(30) Foreign Application Priority Data

Dec. 22, 2006 (JP) ..... 2006-346502

(51) Int. Cl.
*G09G 3/36* (2006.01)

(52) U.S. Cl. ..... 345/98; 345/85; 345/104

(58) Field of Classification Search ..... 345/85–104, 345/20, 212, 204–206
See application file for complete search history.

(56) References Cited

U.S. PATENT DOCUMENTS 5,771,031 A * 6/1998 Kinoshita et al. ..... 345/98
6,130,662 A * 10/2000 Umeda ..... 345/158
6,313,819 B1 * 11/2001 Maekawa et al. ..... 345/92
6,677,925 B1 1/2004 Kawaguchi et al.
2004/0041778 A1 * 3/2004 Hiraki et al. ..... 345/100
2004/0239608 A1 * 12/2004 Chung ..... 345/100
2005/0146907 A1 * 7/2005 Jeon et al. ..... 363/98
2005/0168249 A1 * 8/2005 Dequina et al. ..... 327/110
2005/0174145 A1 * 8/2005 Dosho et al. ..... 326/86
2006/0145995 A1 * 7/2006 Kim et al. ..... 345/98
2006/0164021 A1 * 7/2006 Ryu et al. ..... 315/209 R
2007/0217234 A1 * 9/2007 Nakamura ..... 363/79

FOREIGN PATENT DOCUMENTS

JP 05068374 A * 3/1993
JP 3677100 8/1996

* cited by examiner

*Primary Examiner* — Amare Mengistu
*Assistant Examiner* — Premal Patel
(74) *Attorney, Agent, or Firm* — Turocy & Watson, LLP

(57) ABSTRACT

According to an aspect of the present invention, there is provided an output circuit including a first output unit supplying a first voltage, a second output unit supplying a second voltage, a switching unit selectively outputting, to an output end, the first voltage from the first output unit and the second voltage from the second output unit, a detection unit detecting a voltage of the output end, and a control unit controlling one of the first voltage and the second voltage on the basis of the voltage detected by the detection unit.

19 Claims, 7 Drawing Sheets

OUTPUT CIRCUIT AND LIQUID CRYSTAL DISPLAY DEVICE

CROSS-REFERENCE TO RELATED APPLICATIONS

This application is based upon and claims the benefit of priority from prior Japanese Patent Application No. 2006-346502, filed Dec. 22, 2006, the entire contents of which are incorporated herein by reference.

BACKGROUND OF THE INVENTION

1. Field of the Invention

The present invention relates to an output circuit and liquid crystal display device.

2. Description of the Related Art

In a liquid crystal driving device, it is necessary to ensure the convergence of a constant-voltage output with respect to a voltage fluctuation caused by an external factor acting on a liquid crystal panel. Conventionally, therefore, the voltage is rapidly converged to a constant voltage by decreasing the resistance by increasing the size of a switch of a binary output circuit for outputting the constant voltage. In this case, however, the size of the liquid crystal driving device increases because the switch size of the binary output circuit increases.

Note that a flat panel display device in which a plurality of pixels are arranged in a matrix and a method of driving the display device are disclosed in Japanese Patent No. 3677100.

BRIEF SUMMARY OF THE INVENTION

According to an aspect of the present invention, there is provided an output circuit comprising: a first output unit supplying a first voltage; a second output unit supplying a second voltage; a switching unit selectively outputting, to an output end, the first voltage from the first output unit and the second voltage from the second output unit; a detection unit detecting a voltage of the output end; and a control unit controlling one of the first voltage and the second voltage on the basis of the voltage detected by the detection unit.

According to another aspect of the present invention, there is provided a liquid crystal display device comprising: a liquid crystal panel having a display element to form a pixel at each of intersections of a plurality of scanning lines running along a horizontal scanning direction, and a plurality of signal lines running along a vertical scanning direction; a gate driver driving each of said plurality of scanning lines; and a source driver driving each of said plurality of signal lines by an image signal voltage, the source driver comprising a common voltage generator applying a common voltage to a common electrode of the display element, and the common voltage generator comprising a first output unit supplying a first voltage to the common electrode of the display element; a second output unit supplying a second voltage to the common electrode of the display element, a switching unit selectively outputting, to the common electrode of the display element, the first voltage from the first output unit and the second voltage from the second output unit; a detection unit detecting the common voltage of the display element; and a control unit controlling one of the first voltage and the second voltage on the basis of the common voltage detected by the detection unit.

DETAILED DESCRIPTION OF THE INVENTION

Embodiments will be explained below with reference to the accompanying drawing.

Figure 1:
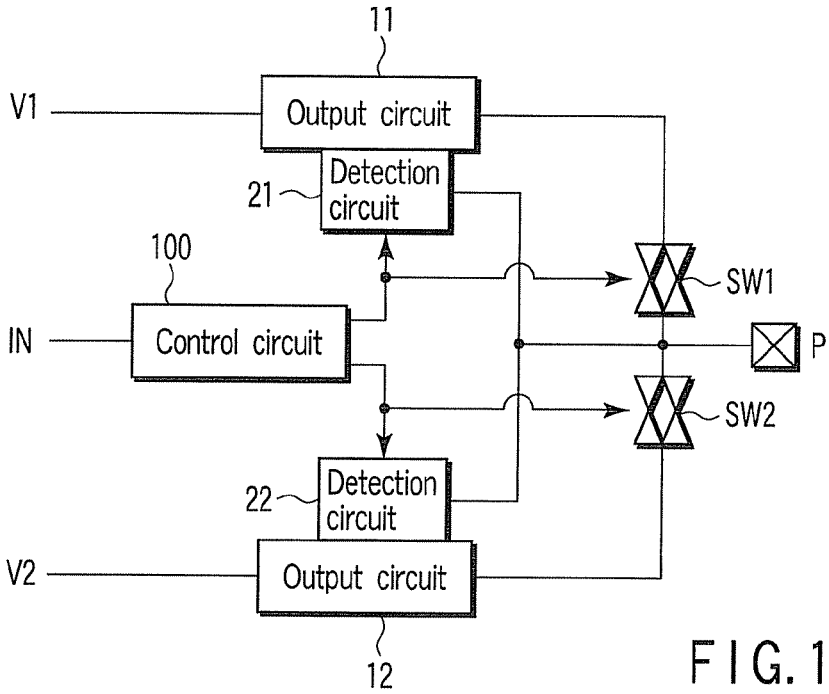
FIG. 1 is a block diagram showing the arrangement of a binary output circuit according to the first embodiment of the present invention.

FIG. 1 is a block diagram showing the arrangement of a binary output circuit according to the first embodiment of the present invention. Referring to FIG. 1, switches SW1 and SW2 are respectively connected to output circuits 11 and 12. The output circuits 11 and 12 respectively include detection circuits 21 and 22. Switches SW1 and SW2 are connected to each other. A control circuit 100 is connected to switches SW1 and SW2 and detection circuits 21 and 22. Switches SW1 and SW2 and detection circuits 21 and 22 are connected to an output terminal P, and connected to a circuit as a voltage supply object.

Voltage source circuits (not shown) supply V1 and V2 representing binary values to the output circuits 11 and 12, respectively. When outputting V1 from the output terminal P, the control circuit 100 closes switch SW1 and opens switch S2, thereby enabling the detection circuit 21. When outputting V2 from the output terminal P, the control circuit 100 opens switch SW1 and closes switch SW2, thereby enabling the detection circuit 22 and disabling the detection circuit 21.

The detection circuits 21 and 22 detect the voltage of the output terminal P. If an external factor changes the voltage of the output terminal P to, e.g., (V1+ΔV) while V1 is output from the output terminal P, the detection circuit 21 detects this voltage (V1+ΔV), and drives the output circuit 11 on the basis of a difference ΔV from V1 so that the voltage of the output terminal P rapidly converges to V1. That is, the output circuit 11 is driven to output {V1−G(ΔV)} so that the voltage of the output terminal P rapidly converges to V1. Here, G(ΔV) is a function which has an inherent value for each output circuit. More specifically, for example, in a case where G(ΔV) is a linear function, when a voltage higher than V1 (ΔV>0) is detected at the output terminal P, the output circuit outputs a voltage lower than V1. Thereby, the voltage of the output terminal P rapidly converges to V1. Conversely, for example, when a voltage lower than V1 ($\Delta V<0$) is detected at the output terminal P, the output circuit outputs a voltage higher than V1. Thereby, the voltage of the output terminal P rapidly converges to V1.

Similarly, if the voltage of the output terminal P changes from V2 while V2 is output to the output terminal P, the detection circuit 22 detects a voltage ($V2+\Delta V$), and drives the output circuit 12 on the basis of a difference $\Delta V$ from V2 so that the voltage of the output terminal P rapidly converges to V2.

The above control can also be performed to switch, e.g., the state in which the V1 is output from the output terminal P to the state in which V2 is output. In this case, the voltage of the output terminal P is kept at V1 when the output from the output terminal P is switched from V1 to V2. Therefore, the detection circuit 22 detects voltage V1, and drives the output circuit 12 on the basis of a difference V1−V2 from V2 so that the voltage of the output terminal P rapidly converges to V2. That is, the output circuit 12 is driven to output {V1−G(V1−V2)} so that the voltage of the output terminal P rapidly converges to V2. Here, G(V1−V2) is a function which has an inherent value for each output circuit. More specifically, for example, in a case where G(V1−N2) is a linear function, when a voltage higher than V2 (V1−V2>0) is detected at the output terminal P, the output circuit outputs a voltage lower than V2. Thereby, the voltage of the output terminal P rapidly converges to V2. Conversely, for example, when a voltage lower than V2 (V1−V2<0) is detected at the output terminal P, the output circuit outputs a voltage higher than V2. Thereby, the voltage of the output terminal P rapidly converges to V1. Note that analog switches or inverters may also be used as switches SW1 and SW2. It is also possible to use a combination of analog switches, a combination of resistors, or a combination of analog switches and resistors as the detection circuits 22 and 21.

By contrast, the conventional binary output circuits outputs V1 (or V2) even if the voltage of the output terminal P changes from V1 (or V2) while V1 (or V2) is output to the output terminal P, unlike the case shown in FIG. 1. This makes it impossible to control the voltage of the output terminal P to rapidly converge to V1 (or V2). In the arrangement of this embodiment, however, the voltage of the output terminal P can be controlled to rapidly converge to V1 (or V2) as described above.

Figure 2:
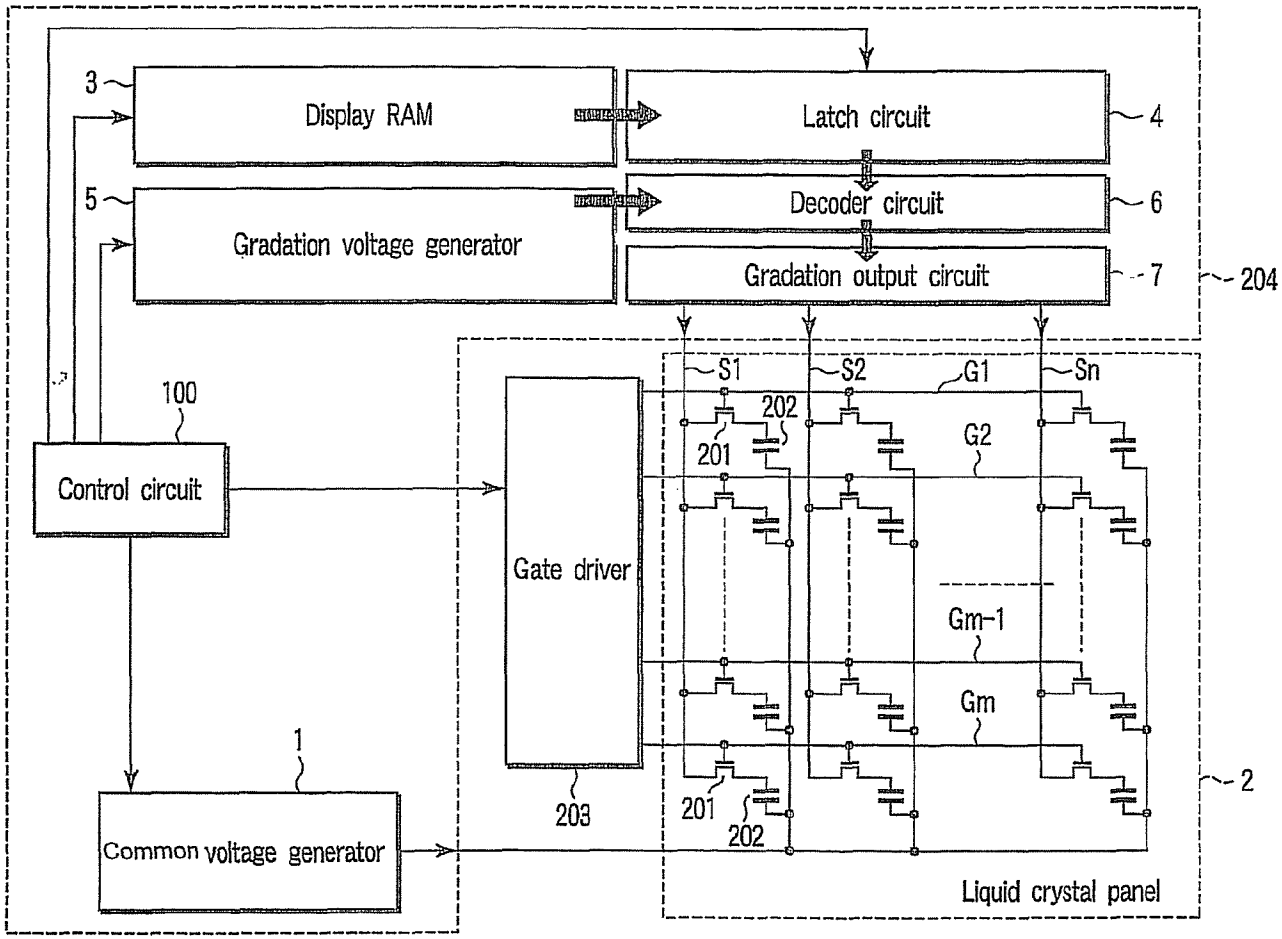
FIG. 2 is a block diagram showing the arrangement of a liquid crystal display device to which a binary output circuit according to the second embodiment of the present invention is applied.

FIG. 2 is a block diagram showing the arrangement of a liquid crystal display device to which a binary output circuit according to the second embodiment of the present invention is applied. In the liquid crystal display device, the binary output circuit having a schematic arrangement described in the first embodiment is applied to a common voltage generator 1.

Referring to FIG. 2, the liquid crystal display device comprises a liquid crystal panel 2, source driver 204, and gate driver 203. In FIG. 2, the source driver 204 comprises the common voltage generator 1, display RAM 3, latch circuit 4, Glay Scale generator (G/S generator) 5, decoder circuit 6, gradation output circuit 7, and control circuit 100. The common voltage generator 1 is a binary output circuit, and connected to the liquid crystal panel 2.

In the liquid crystal panel 2, scanning lines G1 to Gm run along the horizontal scanning direction, and signal lines S1 to Sn run along the vertical scanning direction. Thin-film transistors 201 are formed at the intersections of the signal lines S1 to Sn and scanning lines G1 to Gm. The transistors 201 have sources (S) connected to the signal lines S1 to Sn, and gates (G) connected to the scanning lines G1 to Gm. Capacitors 202 are connected to the drains (D) of the transistors 201 connected to the scanning lines G1 to Gm. The capacitors 202 are connected together for each of the signal lines S1 to Sn. Each capacitor 202 functions as a display element capacitance. A common electrode of the capacitor 202 is connected to the common voltage generator 1.

The control circuit 100 controls the common voltage generator 1, display RAM 3, latch circuit 4, Glay Scale generator 5, and gate driver 203.

The display RAM 3 has a memory area capable of storing image data corresponding to the display screen. The latch circuit 4 latches the image data read from the display RAM 3. The latch circuit 4 outputs the latched image data to the decoder circuit 6. The decoder circuit 6 selects a gradation voltage corresponding to the image data, and outputs the gradation voltage to the signal lines S1 to Sn via the gradation output circuit 7. The gate driver 203 switches the scanning lines G1 to Gm under the control of the control circuit 100.

Figure 3:
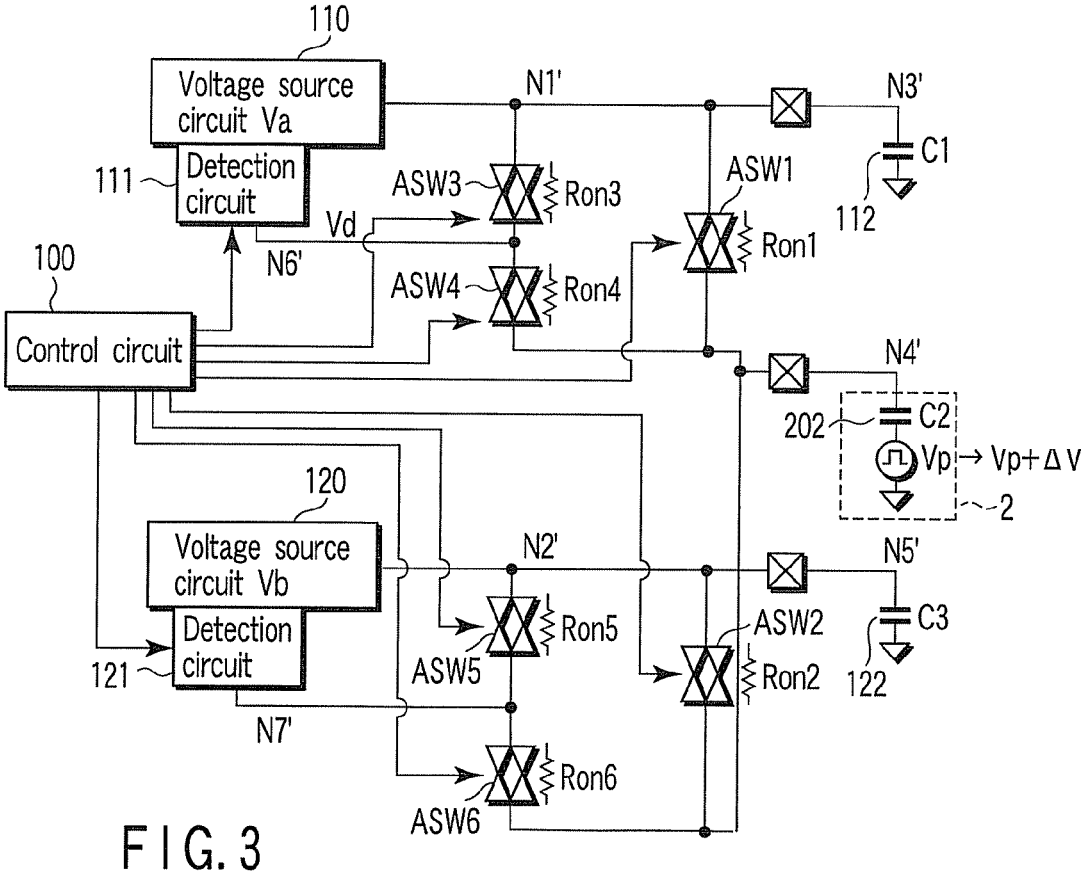
FIG. 3 is a view showing the arrangement of a common voltage generator according to the second embodiment of the present invention.

FIG. 3 is a view showing the arrangement of the common voltage generator 1 shown in FIG. 2. The common voltage generator 1 shown in FIG. 3 generates a binary output by operating analog switches ASW1 and ASW2 connected to voltage source circuits 110 and 120 for outputting constant voltages Va and Vb, respectively.

Referring to FIG. 3, switches ASW1 and ASW2 are respectively connected to the voltage source circuits (Va) 110 and (Vb) 120. Switches ASW1 and ASW2 respectively have resistors Ron1 and Ron2. The voltage source circuits (Va) 110 and (Vb) 120 respectively include detection circuits 111 and 121.

Switches ASW1 and ASW2 are connected to each other. A series circuit of analog switches ASW3 and ASW4 is connected in parallel with switch ASW1. Switches ASW3 and ASW4 respectively have resistors Ron3 and Ron4. A series circuit of analog switches ASW5 and ASW6 is connected in parallel with switch ASW2. Switches ASW5 and ASW6 respectively have resistors Ron5 and Ron6.

The detection circuit 111 is connected to the connection node of switches ASW3 and ASW4, and the detection circuit 121 is connected to the connection node of switches ASW5 and ASW6. The control circuit 100 is connected to switches ASW1 to ASW6 and detection circuits 111 and 121. The common voltage generator 1 is connected to voltage holding capacitors 112 and 122 and the liquid crystal panel 2 as a voltage supply object shown in FIG. 2.

Figure 4:
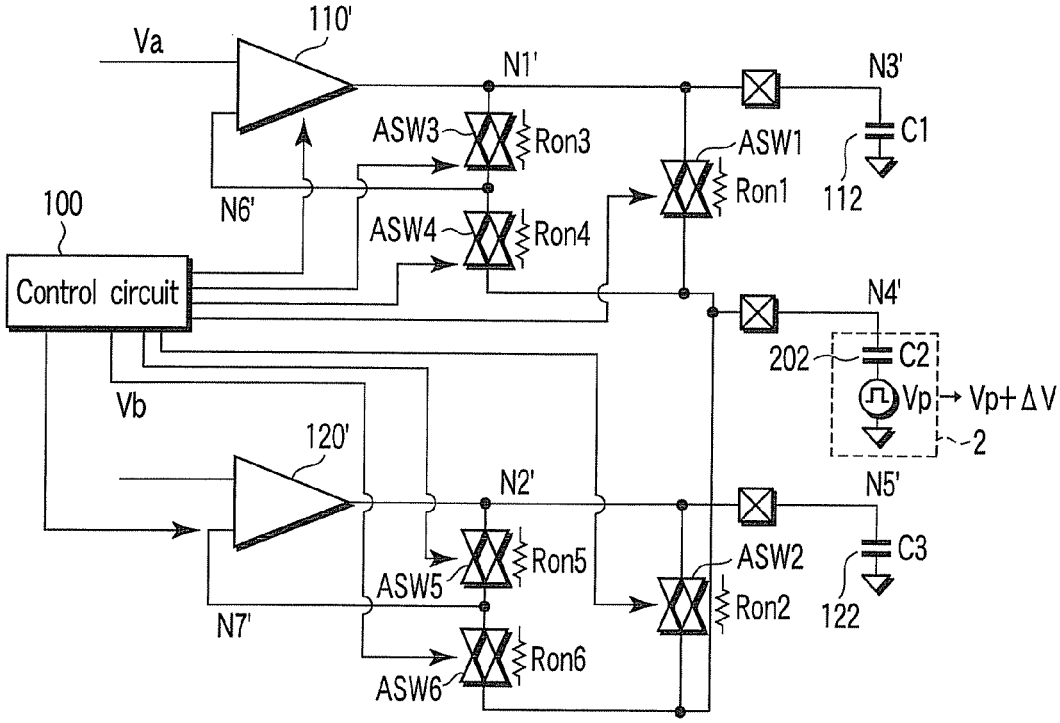
FIG. 4 is a view showing a practical arrangement of the common voltage generator according to the second embodiment of the present invention.

FIG. 4 is a view showing a practical arrangement of the common voltage generator 1 shown in FIG. 3. The same reference numbers as in FIG. 3 denote the same parts in FIG. 4. Referring to FIG. 4, a differential amplifier 110' implements the voltage source circuit (Va) 110 and detection circuit 111 shown in FIG. 3, and a differential amplifier 120' implements the voltage source circuit (Vb) 120 and detection circuit 121 shown in FIG. 3.

The operation of the common voltage generator 1 according to the second embodiment will be explained below with reference to FIG. 3. First, switches ASW1, ASW3, ASW4, and ASW5 are ON, and switches ASW2 and ASW6 are OFF. As a consequence, voltage Va is applied to the capacitor 202. In this state, the potentials of nodes N1', N3', and N4' are $$VN1'=VN3'=VN4'=Va.$$

If an external factor applies $\Delta V$ to a voltage Vp applied to the capacitor 202, the potential of node N4' rises to ($Va+\Delta V$). By contrast, the potential of node N3' is maintained at Va. That is, $$VN3'=Va, VN4'=Va+\Delta V.$$

In this state, the ratio of resistor Ron3 of switch ASW3 to resistor Ron4 of switch ASW4 determines the potential of a node N6' positioned in the detection circuit 111. That is, $$VN6'=VN1'+\Delta V\times\{Ron3/(Ron3+Ron4)\}.$$

Accordingly, a voltage Vd to be supplied to the detection circuit 111 can be varied by changing the ratio of Ron3 to Ron4. The voltage source circuit 110 is operated on the basis of a difference voltage Vd−Va between the detected voltages Vd and Va so that VN4' rapidly converges to Va. That is, the voltage source circuit 110 is operated to output {Va−G(Va−Vd)} so that the voltage of the VN4' rapidly converges to Va. Here, G(Va−Vd) is a function which has an inherent value for each voltage source circuit. More specifically, for example, in a case where G(Va−Vd) is a linear function, when a voltage higher than Va (Va−Vd>0) is detected at the node VN4', the voltage source circuit outputs a voltage lower than Va. Thereby, the voltage of the node VN4' rapidly converges to Va. Conversely, for example, when a voltage lower than Va (Va−Vd<0) is detected at the node VN4', the voltage source circuit outputs a voltage higher than V1. Thereby, the voltage of the node VN4' rapidly converges to Va. As described above, it is possible by actively operating the voltage source circuit 110 to converge the voltage of the capacitor 202 to constant voltage Va faster than a time constant obtained with resistor Ron1 of switch ASW1 and capacitance C2 of the capacitor 202.

The above control can also be performed to switch, e.g., the state in which Va is supplied to the capacitor 202 to the state in which Vb is supplied. In this case, voltage Va is initially applied to the capacitor 202 because switches ASW1, ASW3, ASW4, and ASW5 are ON and switches ASW2 and ASW6 are OFF. Then, switches ASW2, ASW5, ASW6, and ASW3 are ON and switches ASW1 and ASW4 are OFF in order to switch the voltage from Va to Vb.

Assume that when the above operation is performed an external factor applies ΔV to voltage Va applied to the capacitor 202 and the potential of node N4' changes to (Va+ΔV). The ratio of resistor Ron5 of switch ASW5 to resistor Ron6 of switch ASW6 determines the potential of a node N7' positioned in the detection circuit 121, and voltage Vd to be supplied to the detection circuit 121 is variable. The voltage source circuit 120 is operated on the basis of a difference voltage Vd−Vb between detected voltages Vd and Vb such that VN4' rapidly converges to Vb. That is, the voltage source circuit 120 is operated to output {Vb−G(Vd−Vb)} so that the voltage of the VN4' rapidly converges to Vb. Here, G(Vd−Vb) is a function which has an inherent value for each voltage source circuit. More specifically, for example, in a case where G(Vd−Vb) is a linear function, when a voltage higher than Vb (Vd−Vb>0) is detected at the node VN4', the voltage source circuit outputs a voltage lower than Vb. Thereby, the voltage of the node VN4' rapidly converges to Vb. Conversely, for example, when a voltage lower than Vb (Vd−Vb<0) is detected at the node VN4', the voltage source circuit outputs a voltage higher than Vb. Thereby, the voltage of the node VN4' rapidly converges to Vb. As described above, it is possible by actively operating the voltage source circuit 120 to converge the voltage on the common electrode side of the capacitor 202 to constant voltage Vb faster than a time constant obtained with resistor Ron2 of switch ASW2 and capacitance C2 of the capacitor 202.

Figure 5:
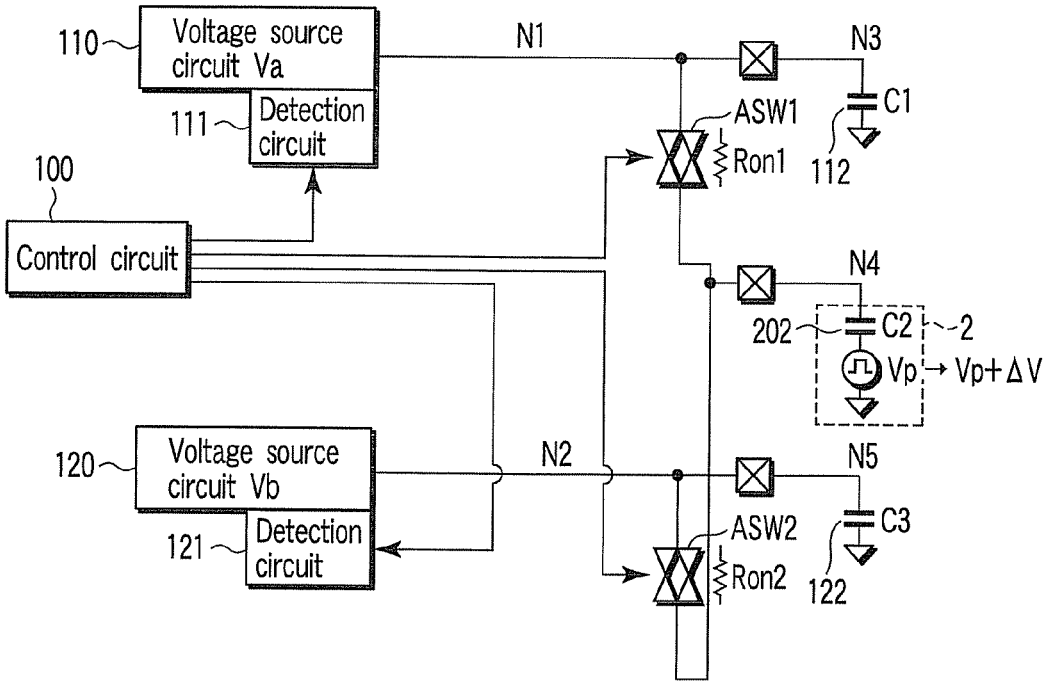
FIG. 5 is a view showing the arrangement of a common voltage generator according to a conventional example as a comparative example of the second embodiment of the present invention.

FIG. 5 is a view showing the arrangement of a common voltage generator according to a conventional example as a comparative example of the second embodiment. This common voltage generator shown in FIG. 5 generates a binary output by operating switches ASW1 and ASW2 connected to voltage source circuits 110 and 120 for outputting constant voltages Va and Vb, respectively.

The same reference numbers as in FIG. 3 denote the same parts in FIG. 5. Referring to FIG. 5, switches ASW1 and ASW2 are respectively connected to the voltage source circuits (Va) 110 and (Vb) 120. Switches ASW1 and ASW2 respectively have resistors Ron1 and Ron2. The voltage source circuits (Va) 110 and (Vb) 120 respectively include detection circuits 111 and 121. Switches ASW1 and ASW2 are connected to each other.

A control circuit 100 is connected to switches ASW1 and ASW2 and detection circuits 111 and 121. This common voltage generator is connected to voltage holding capacitors 112 and 122 and a liquid crystal panel 2 as a voltage supply object.

The operation of the common voltage generator according to the conventional example will be explained below with reference to FIG. 5. Initially, switch ASW1 is ON, and switch ASW2 is OFF. As a consequence, voltage Va is applied to a capacitor 202. In this state, the potentials of nodes N1, N3, and N4 are $$VN1=VN3=VN4=Va.$$

If an external factor applies ΔV to a voltage Vp applied to the capacitor 202, the potential of node N4 rises to Va+ΔV. On the other hand, the potential of node N3 is maintained at Va. That is, $$VN3=Va, VN4=Va+\Delta V.$$

In this state, a time constant obtained by on-resistance component Ron1 and capacitance C2 of switch ASW1 determines a period required for the potential of node N4 to converge to original voltage Va. To ensure sufficient convergence, therefore, the on-resistance must be suppressed by increasing the switch size.

By contrast, in the common voltage generator according to the embodiment of the present invention described above, switches ASW3 to ASW6 are added to the circuit that generates the binary output voltage by switching the two voltage source circuits 110 and 120. If a voltage fluctuation caused by an external factor changes the potential of the liquid crystal panel, therefore, the voltage source circuits are positively operated by actively varying the voltage amplitude input to the detection system. These makes it possible to downsize the common voltage generator without increasing the size of switches ASW1 and ASW2, and increase the convergence of the constant-voltage output with respect to the fluctuation in binary output voltage caused by an external factor.

Figure 6:
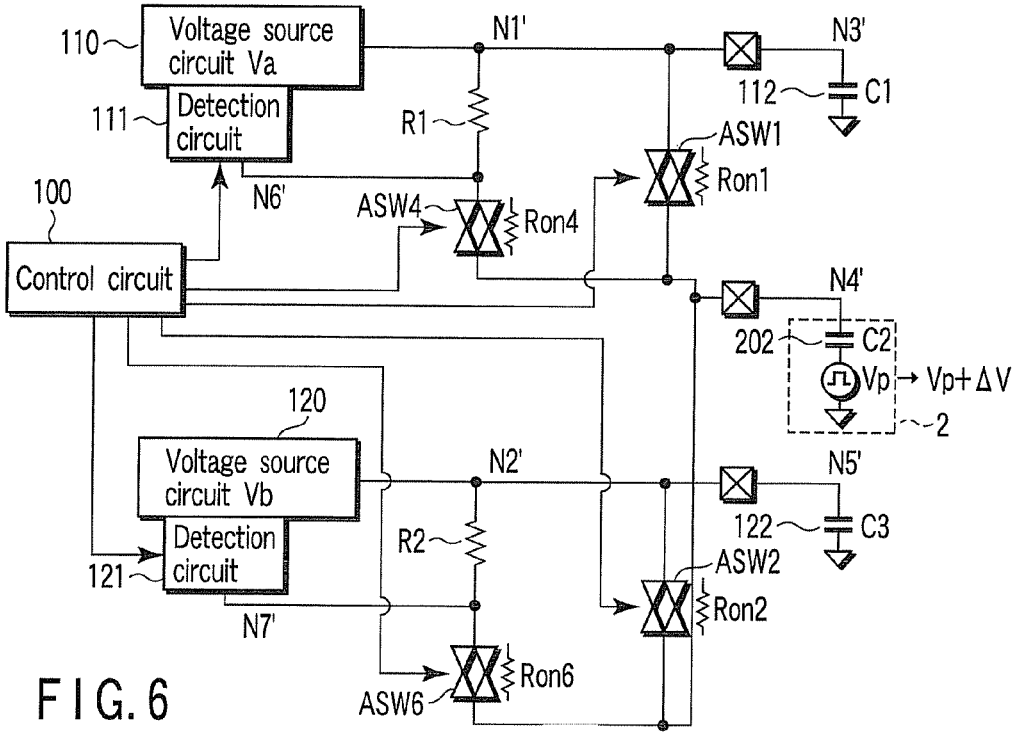
FIG. 6 is a block diagram showing the arrangement of a binary output circuit according to the third embodiment of the present invention.

FIG. 6 is a block diagram showing the arrangement of a binary output circuit according to the third embodiment of the present invention. This binary output circuit is applied to the common voltage generator 1 shown in FIG. 2. The same reference numbers as in FIG. 3 denote the same parts in FIG. 6. Referring to FIG. 6, resistors R1 and R2 are used instead of the switches ASW3 and ASW5, thereby simply configuring the binary output circuit. Note that a resistor may be used instead of one of the switches ASW3 and ASW5.

Figure 7:
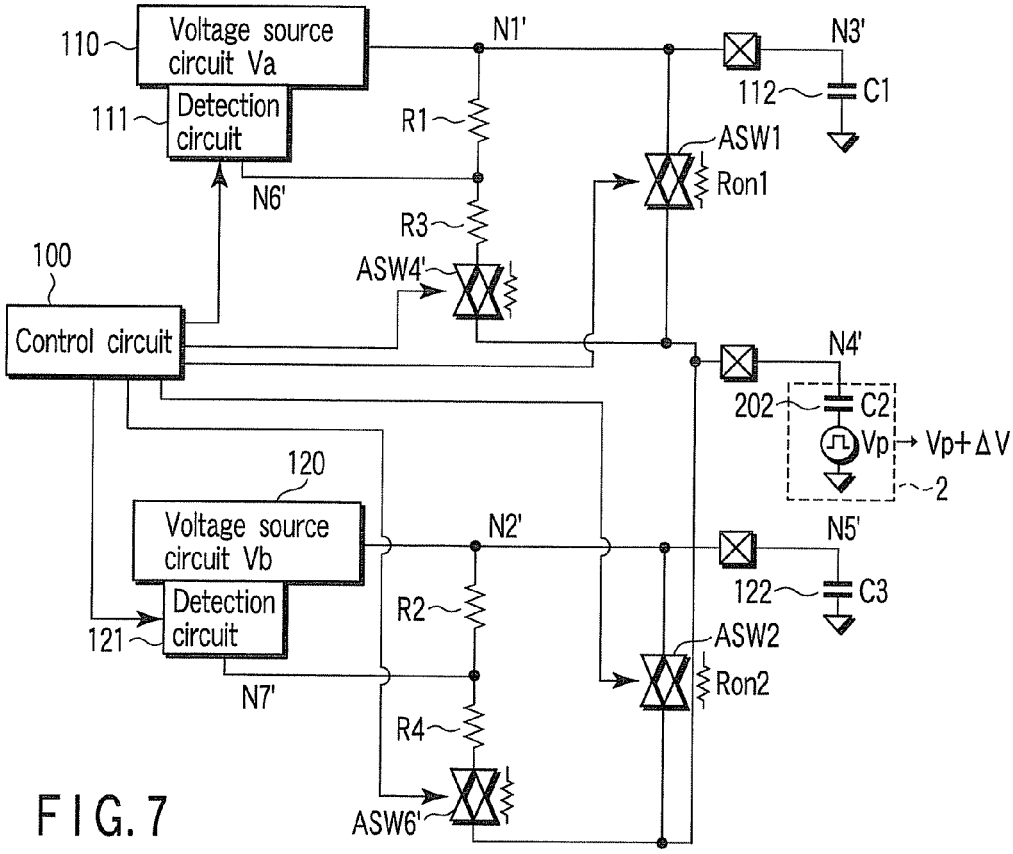
FIG. 7 is a block diagram showing the arrangement of a binary output circuit according to the fourth embodiment of the present invention.

FIG. 7 is a block diagram showing the arrangement of a binary output circuit according to the fourth embodiment of the present invention. This binary output circuit is applied to the common voltage generator 1 shown in FIG. 2. The same reference numbers as in FIG. 3 denote the same parts in FIG. 7.

Referring to FIG. 7, resistors R1 and R2 may be used instead of the switches ASW3 and ASW5, a series circuit of a resistor R3 and an analog switch ASW4' may be used instead of the switch ASW4, and a series circuit of a resistor R4 and an analog switch ASW6' may be used instead of the switch ASW6. Note the above configuration may be used instead of one of the series circuit of switches ASW3 and ASW4 and the series circuit of switches ASW5 and ASW6. Alternatively, the switches ASW3 and ASW5 may be used while the series circuit of the resistor R3 and the analog switch ASW4' and the series circuit of the resistor R4 and the analog switch ASW6' are used.

Figure 8:
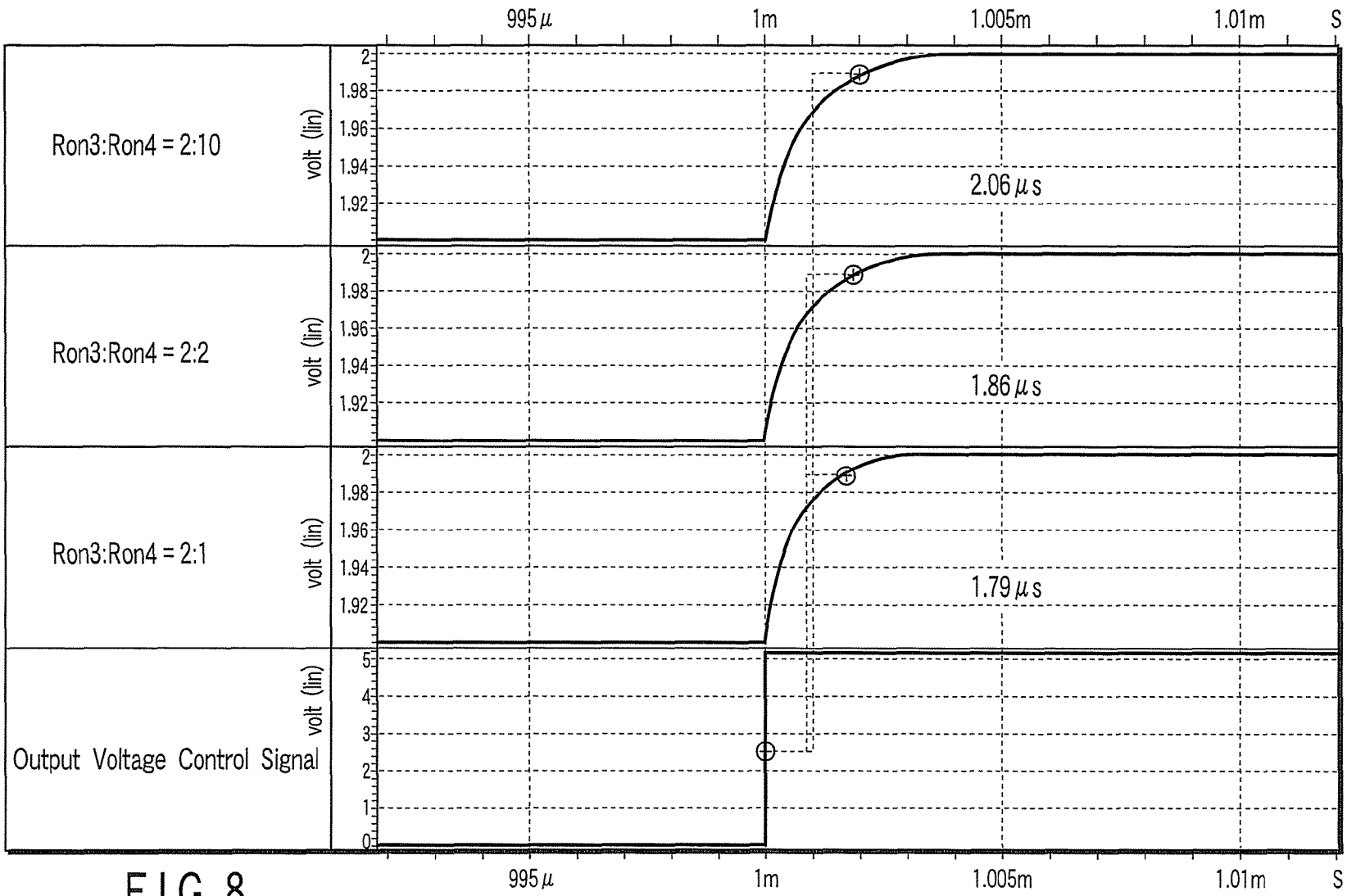
FIG. 8 shows a verification result of the convergence property of the constant voltage output verified by using the binary output circuit shown in FIG. 4.

FIG. 8 shows a verification result of the convergence property of the constant voltage output verified by using the binary output circuit shown in FIG. 4. In FIG. 8, the horizontal axis indicates time (s), and the vertical axis indicates voltage of N4', which is the measurement point. The differential amplifiers 110' and 120' output constant voltage Va (2.0 V) and Vb (1.9 V), respectively. FIG. 8 shows the convergence property of the constant voltage output of the differential amplifiers 110' in the binary output circuit shown in FIG. 4 with the resistance ratio of the switch ASW3 to the switch ASW4 changed. In FIG. 8, the ratio of the resistance of the resistor Ron3 of the switch ASW3 to that of the resistor Ron4 of the switch ASW4 is set to 2:10, 2:2, and 2:1. FIG. 8 shows a case where voltage supplied to the capacitor is changed from Vb to Va.

In FIG. 4, while the differential amplifier 120' outputs Vb, the control circuit 100 outputs an output voltage control signal, resulting in a state where the switches ASW1, ASW3, ASW4, and ASW5 are ON, and the switches ASW2 and ASW6 are OFF. Thereby, Va is applied to the capacitor 202. In this case, the convergence times up to (Va−10) mV are as shown in FIG. 8. When Ron3:Ron4 is 2:10, the convergence time is 2.06 μs, 2:2, 1.86 μs, and 2:1, 1.79 μs. As stated above, as the resistance Ron4 of the switch ASW4 decreases with respect to the resistance Ron3 of the switch ASW3, the convergence property improves.

Figure 9:
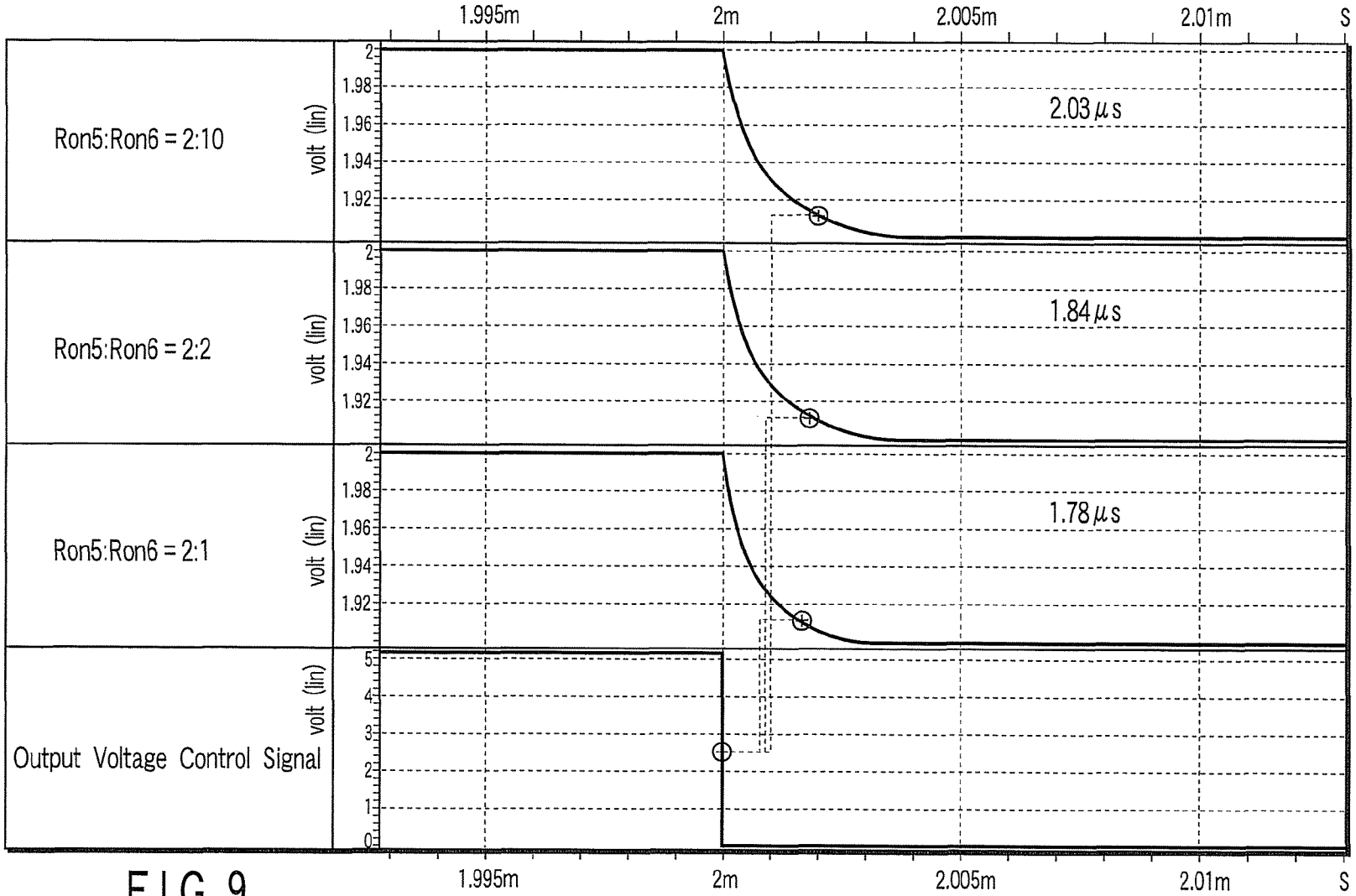
FIG. 9 shows the convergence property of the constant voltage output of the differential amplifier 120' in the binary output circuit shown in FIG. 4.

FIG. 9 shows the convergence property of the constant voltage output of the differential amplifier 120' in the binary output circuit shown in FIG. 4. In FIG. 9, the horizontal axis indicates time (s), and the vertical axis indicates voltage of N4', which is the measurement point. In FIG. 9, the ratio of the resistance of the resistor Ron5 of the switch ASW5 to that of the resistor Ron6 of the switch ASW6 (Ron5:Ron6) is set to 2:10, 2:2, and 2:1. FIG. 9 shows a case where voltage supplied to the capacitor 202 is changed from Va to Vb.

In FIG. 9, while the differential amplifier 110' outputs Va, the control circuit 100 outputs an output voltage control signal, resulting in a state where the switches ASW2, ASW5, ASW6, and ASW3 are ON, and the switches ASW1 and ASW4 are OFF. Thereby, Vb is applied to the capacitor 202. In this case, the convergence times down to (Vb+10) mV are as shown in FIG. 9. When Ron5:Ron6 is 2:10, the convergence time is 2.03 μs, 2:2, 1.84 μs, and 2:1, 1.78 μs. As stated above, as the resistance Ron6 of the switch ASW6 decreases with respect to the resistance Ron5 of the switch ASW5, the convergence property improves.

Figure 10:
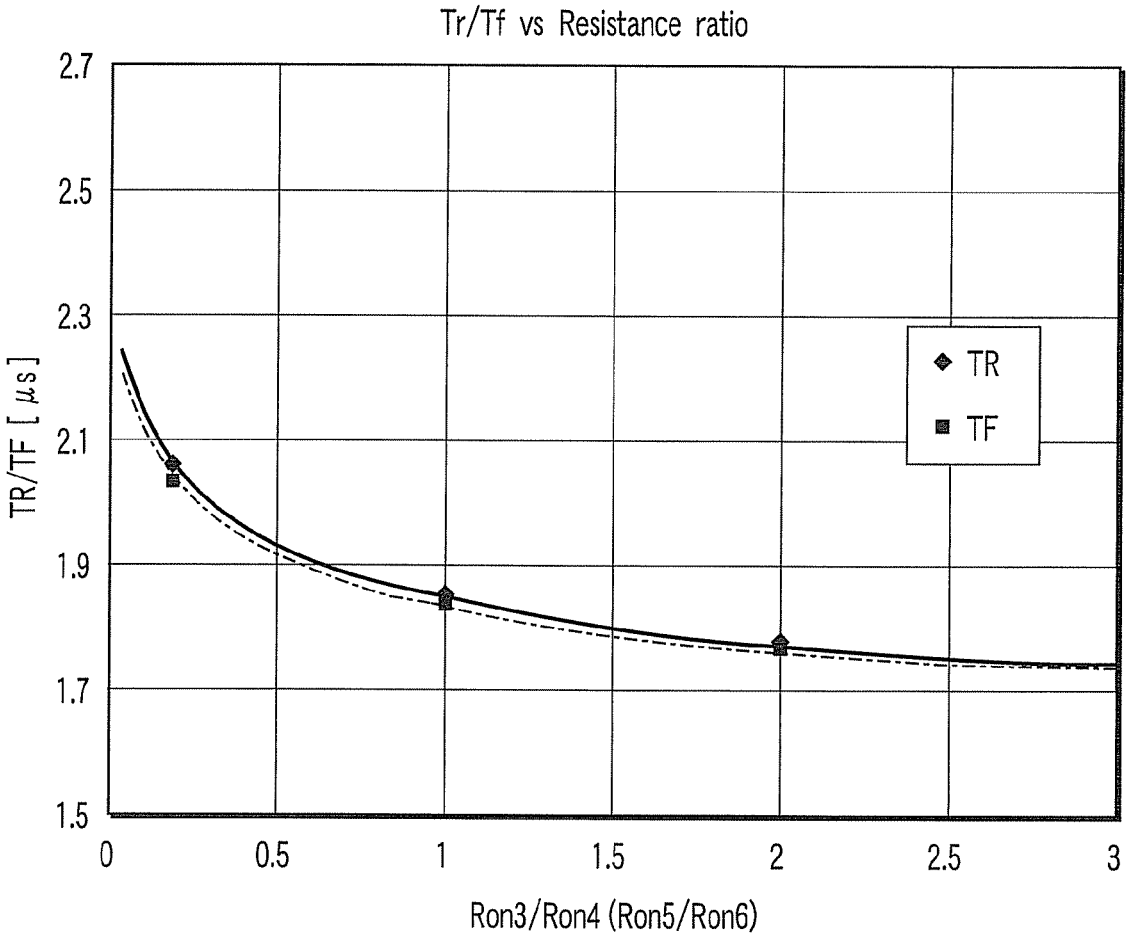
FIG. 10 is a diagram in which the convergence properties of the constant voltage output shown in FIGS. 8 and 9 are compared with each other.

FIG. 10 is a diagram in which the convergence properties of the constant voltage output shown in FIGS. 8 and 9 are compared with each other. In FIG. 10, the horizontal axis indicates the resistance ratio Ron3/Ron4 and the resistance ratio Ron5/Ron6, and the vertical axis indicates the convergence time (TR) up to (Va−10) mV and the convergence time (TF) down to (Vb+10) mV. As shown in FIG. 10, as the resistance ratios increase, both of the convergence times TR and TF decrease, thereby improving the convergence properties.

Note that the convergence property of the constant voltage output can be improved by changing not only the resistance ratio in the configuration shown in FIG. 4 but the resistance ratio in another configuration.

As described above, the embodiment can provide an output circuit and liquid crystal display device capable of increasing the operating speed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An output circuit comprising:

a first output unit supplying a first voltage;

a second output unit supplying a second voltage;

a switching unit selectively outputting, to an output end, the first voltage from the first output unit and the second voltage from the second output unit;

a detection unit detecting a voltage of the output end, wherein the detection unit includes a first detection unit and a second detection unit, the first detection unit detects a voltage of the output end when the first voltage from the first output unit is output to the output end, the second detection unit detects a voltage of the output end when the second voltage from the second output unit is output to the output end, and the control unit controls the first voltage on the basis of a voltage detected by the first detection unit, and controls the second voltage on the basis of a voltage detected by the second detection unit; and a control unit controlling one of the first voltage and the second voltage on the basis of the voltage detected by the detection unit.

2. The circuit according to claim 1, wherein the detection unit detects one of an increase and a decrease in voltage of the output end, and the control unit controls one of the first voltage and the second voltage in accordance with one of the increase and the decrease.

3. The circuit according to claim 2, wherein the control unit controls the first voltage or the second voltage to decrease the first voltage or the second voltage when detecting the increase, and controls the first voltage or the second voltage to increase the first voltage or the second voltage when detecting the decrease.

4. The circuit according to claim 1, wherein the switching unit has an analog switch.

5. The circuit according to claim 1, wherein the first detection unit comprises a first switch portion having an end and a second switch portion having a first end and a second end, the end of the first switch portion connected to the first output unit, the first end of the second switch portion connected to the first switch portion, and the second end of the second switch portion connected to the output end, the first detection unit detects a voltage of a common node of the first switch portion and the second switch portion, the second detection unit comprises a third switch portion having an end and a fourth switch portion having a first end and a second end, the end of the third switch portion connected to the second output unit, the first end of the fourth switch portion connected to the third switch portion, and the second end of the fourth switch portion connected to the output end, and the second detection unit detects a voltage of a common node of the third switch portion and the fourth switch portion.

6. The circuit according to claim 5, wherein at least one of the first to fourth switch portions includes a resistor.

7. The circuit according to claim 5, wherein at least one of the first to fourth switch portions includes an analog switch.

8. The circuit according to claim 5, wherein the first switch portion includes a first resistance component, and the second switch portion includes a second resistance component, and the first resistance component is larger than the second resistance component.

9. The circuit according to claim 5, wherein the third switch portion includes a third resistance component, and the fourth switch portion includes a fourth resistance component, and the third resistance component is larger than the fourth resistance component.

10. The circuit according to claim 5, wherein at least one of the first switch portion and the third switch portion is a resistor.

11. The circuit according to claim 5, wherein at least one of the second switch portion and the fourth switch portion comprises a cascade circuit of a resistor and an analog switch.

12. A liquid crystal display device comprising:

a liquid crystal panel having a display element to form a pixel at each of intersections of a plurality of scanning lines running along a horizontal scanning direction, and a plurality of signal lines running along a vertical scanning direction;

a gate driver driving each of said plurality of scanning lines; and a source driver driving each of said plurality of signal lines by an image signal voltage, the source driver comprising a common voltage generator applying a common voltage to a common electrode of the display element, and the common voltage generator comprising a first output unit supplying a first voltage to the common electrode of the display element;

a second output unit supplying a second voltage to the common electrode of the display element, a switching unit selectively outputting, to the common electrode of the display element, the first voltage from the first output unit and the second voltage from the second output unit;

a detection unit detecting the common voltage of the display element; and a control unit controlling one of the first voltage and the second voltage on the basis of the common voltage detected by the detection unit.

13. The device according to claim 12, wherein the detection unit detects one of an increase and a decrease in common voltage of the display element, and the control unit changes one of the first voltage and the second voltage in accordance with one of the increase and the decrease.

14. The device according to claim 13, wherein the control unit controls the first voltage or the second voltage to decrease the first voltage or the second voltage when detecting the increase, and controls the first voltage or the second voltage to increase the first voltage or the second voltage when detecting the decrease.

15. The device according to claim 12, wherein the detection unit includes a first detection unit and a second detection unit, the first detection unit detects a voltage of the common electrode when the first voltage from the first output unit is output to the common electrode, the second detection unit detects a voltage of the common electrode when the second voltage from the second output unit is output to the common electrode, and the control unit controls the first voltage on the basis of a voltage detected by the first detection unit, and controls the second voltage on the basis of a voltage detected by the second detection unit.

16. The device according to claim 15, wherein the first detection unit comprises a first switch portion having an end and a second switch portion having a first end and a second end, the end of the first switch portion connected to the first output unit, the first end of the second switch portion connected to the first switch portion, and the second end of the second switch portion connected to the common electrode, the first detection unit detects a voltage of a common node of the first switch portion and the second switch portion, the second detection unit comprises a third switch portion having an end and a fourth switch portion having a first end and a second end, the end of the third switch portion connected to the second output unit, the first end of the fourth switch portion connected to the third switch portion, and the second end of the fourth switch portion connected to the common electrode, and the second detection unit detects a voltage of a common node of the third switch portion and the fourth switch portion.

17. The device according to claim 15, wherein the first switch portion includes a first resistance component, the second switch portion includes a second resistance component, and the first resistance component is larger than the second resistance component, the third switch portion includes a third resistance component, and the fourth switch portion includes a fourth resistance component, and the third resistance component is larger than the fourth resistance component.

18. The device according to claim 15, wherein at least one of the first switch portion and the third switch portion is a resistor.

19. The device according to claim 15, wherein at least one of the second switch portion and the fourth switch portion comprises a cascade circuit of a resistor and an analog switch.

* * * * *